United States Patent [19]

Howlett et al.

[11] 4,053,974

[45] Oct. 18, 1977

[54] METHOD OF FORMING A CONCRETE STRUCTURE WITH A RECESS TO RECEIVE AN ANCHORAGE

[75] Inventors: George H. Howlett; James W. Howlett, both of Oakland, Calif.

[73] Assignee: Conenco International Limited, Toronto, Canada

[21] Appl. No.: 654,050

[22] Filed: Jan. 30, 1976

Related U.S. Application Data

[60] Division of Ser. No. 119,710, March 1, 1971, Pat. No. 3,936,256, which is a continuation-in-part of Ser. No. 816,583, April 16, 1969, Pat. No. 3,605,361.

[51] Int. Cl.[2] ..... B23P 11/02

[52] U.S. Cl. ..... 29/452; 29/460; 29/525; 52/223 R; 264/228; 264/275

[58] Field of Search ..... 29/428, 526, 452, 460, 29/525; 52/223 R, 226; 264/271, 275, 278, 228; 249/91, 94, 97; 425/111

[56] References Cited

U.S. PATENT DOCUMENTS

| | | | |
|---|---|---|---|
| 3,247,635 | 4/1966 | Burns | 52/223 L |
| 3,399,434 | 9/1968 | Kelly | 425/111 |
| 3,408,783 | 11/1968 | Rice | 52/223 L |
| 3,833,706 | 9/1974 | Edwards | 264/228 |

*Primary Examiner*—Charlie T. Moon
*Attorney, Agent, or Firm*—Warren, Chickering & Grunewald

[57] ABSTRACT

A tendon anchorage for use in prestressing concrete members is disclosed which preferably includes a tubular mounting means mounted to extend over the tendon and through an opening in a bearing or anchor plate in order to secure the bearing plate in fixed and aligned relation to a tendon for casting the bearing plate into the concrete member in a predetermined orientation therein. Spacing means between the form board and the anchor plate allow the anchor plate to be cast into a recess in the concrete member. A wedge receiving housing and wedge assembly is positioned in alignment and in abutting relation with the bearing plate after casting of the bearing plate into the concrete.

2 Claims, 4 Drawing Figures

Fig. 1
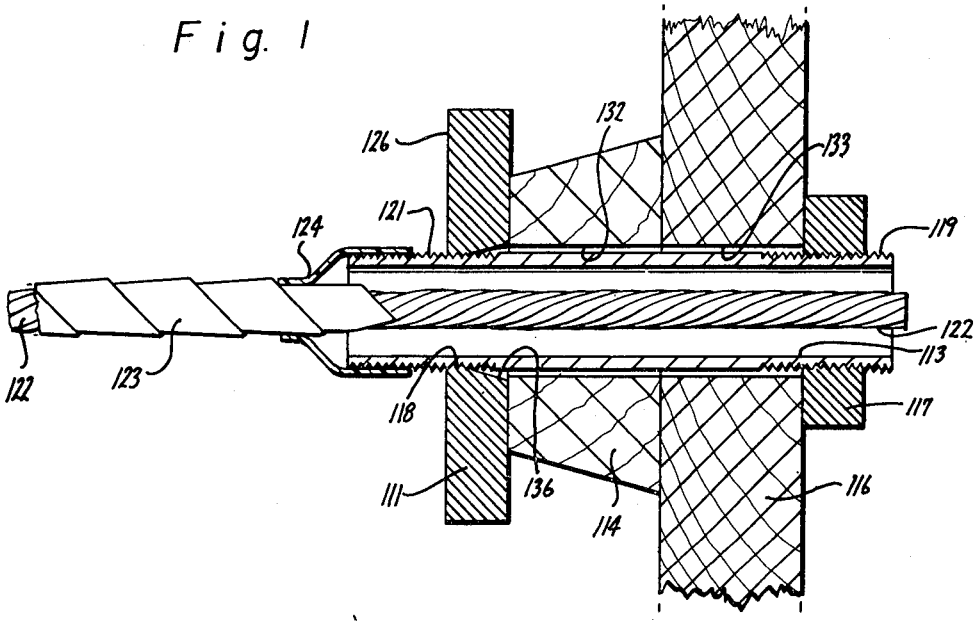
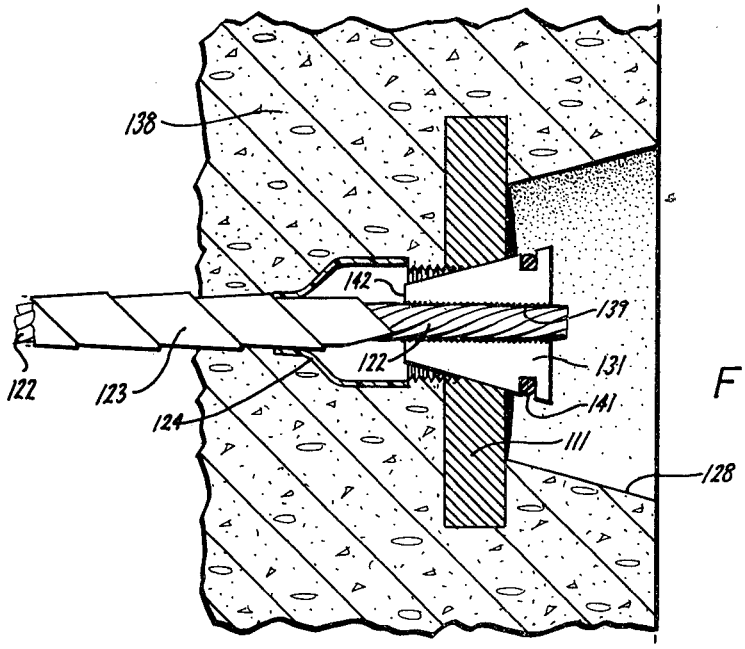
Fig. 2

Fig. 3
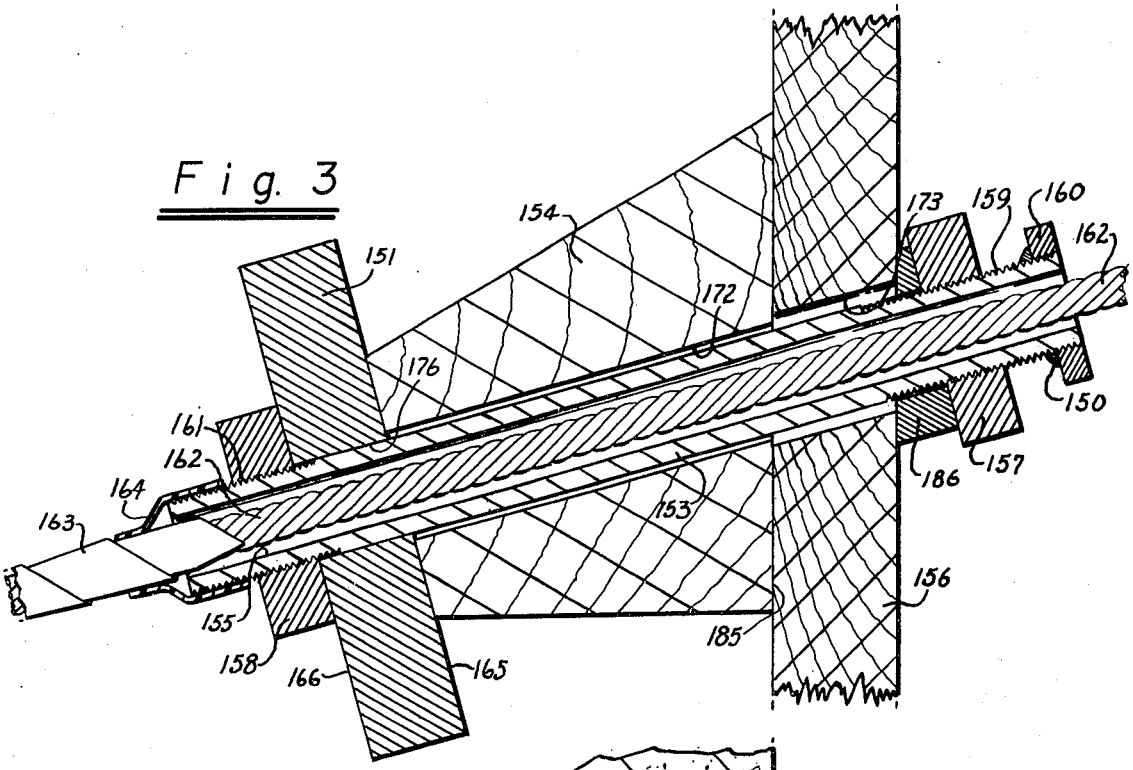
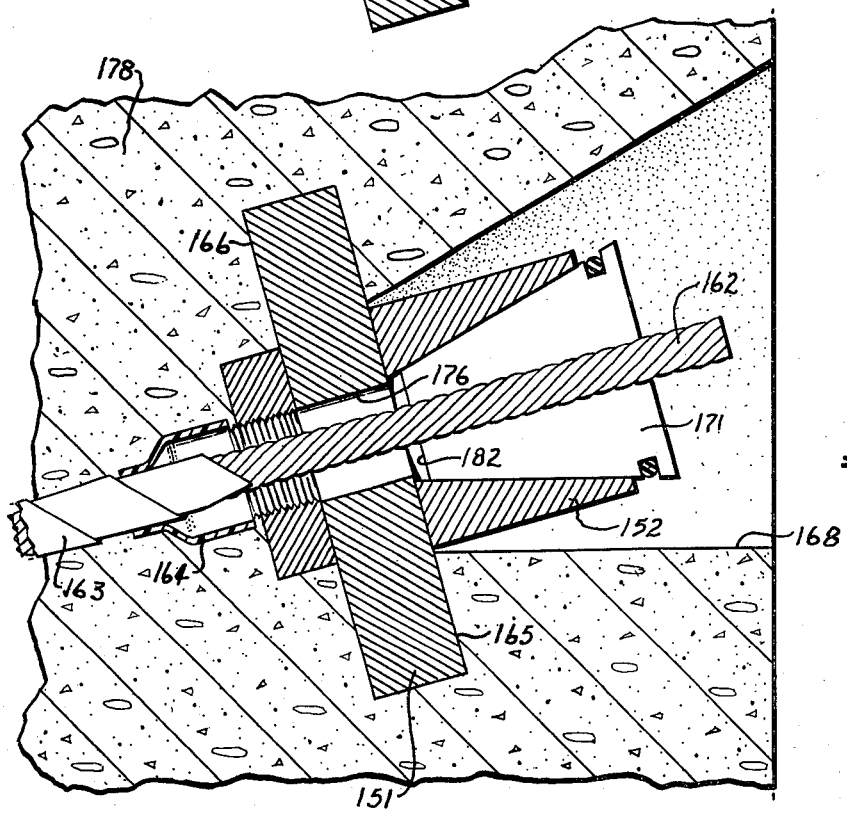
Fig. 4

METHOD OF FORMING A CONCRETE STRUCTURE WITH A RECESS TO RECEIVE AN ANCHORAGE

This is a divisional application of applicaton Ser. No. 119,710, filed Mar. 1, 1971, issued on Feb. 3, 1976 as U.S. Pat. No. 3,936,256. Application Ser. No. 119,710 was a continuation-in-part application of application Ser. No. 816,583, filed on Apr. 16, 1969, issued on Sept. 20, 1971 as U.S. Pat. No. 3,605,361.

BACKGROUND OF THE INVENTION

In the construction of many concrete members and particularly floor slabs and slab walls it has been found to be particularly advantageous to use a prestressed concrete construction. Tupicaly, a plurality of tendons and tendon anchorages are placed within the concrete forms and the concrete is then poured with the tendon and anchorage being cast-in-place. The forms are then removed and the tendons are tensioned. It also has been found to be desirable in many applications to have the tenson anchorage located in a recess in the end of the concrete member, which recess is subsequently grouted so that the anchorage is completely contained within the finished prestressed concrete member. When this type of construction is used, the tendon anchorage must be located and positioned in fixed spaced relation to the concrete form by means of apparatus which, after casting of the concrete member, afford access to the anchorage for tensioning of the tendon.

Several anchorages have been previously employed in order to provide an anchorage construction which can be cast-in-place at a position interiorly of the ends of the concrete member. Two such anchorage constructions are illustrated in U.S. Pat. Nos. 3,293,811 and 3,399,434. Another approach has been to provide a unitary anchorage member which is formed with screw threads or a bayonet-type socket on the side of the anchorage facing the form. A mounting member is then screwed into the front of the anchorage and extends therefrom to and through the form.

Prior cast-in-place anchorage systems have been found to have several disadvantages. Primary among these disadvantages is the inflexibility of the system for mounting the anchorage in spaced relation to the concrete form. As will be readily understood, the prestressing reqirements of various concrete members may differ considerably. For example, the depth to which a cast-in-place anchorage must be placed in the concrete member may under different construction codes vary from state to state or locality to locality. Similarly, tensioning forces may require various sizes or shapes of bearing surfaces in order to properly distribute the axial loading of the tendon or tendons. Moreover, close grouping of tendons may result in special bearing plate requirements. Still further, special wedge containing anchor members may be required for given stress conditions. Thus, prior tendon anchorages hve lacked an interchangeability or flexibility of the elements in the systems which would allow the structural engineer maximum flexiblity of design.

Accordingly, it is an object of the concrete prestressing tendon anchorage of the present invention to provide an improved anchorage construction and method of anchorage support which affords greater flexiblity in meeting design criteria by means of allowing easy interchangeability of the parts while maintaining the characteristic of being rapidly mountable on the concrete form for casting of the concrete member.

It is another object of the present invention to provide a tendon anchorage wherein the parts of the anchorage can be readily and easily formed, stored and shipped.

It is still another object of the tendon anchorage of the present invention to provide an anchorage construction which can be conveniently and easily adjusted under field conditions and minimizes the exposure of the anchorage to damage and corrosion in the field.

Still another object of the tendon anchorage of the present invention is to provide an anchorage construction wherein a multiplity of side-by-side tendons can be conveniently and easily secured.

SUMMARY OF THE INVENTION

Briefly, the tendon anchorage of the present invention includes, tubular mounting means extending from a form board inwardly through an opening located in a spacer and through an opening in a bearing plate. The opening in the bearing plate engages the mounting tube in a manner causing the bearing plate to be oriented in perpendicular relation to the mounting tube and the mounting tube is coaxially aligned with a tendon, which passes down the inside thereof. The beraing plate may be formed with a tapered bore or opening to act as an anchor upon insertion of wedges into the tapered bore. The mounting means is preferably continuously threaded over a substantial portion of the end which is secured to the anchor plate in order that it may receive a nut or other fastener on the remote side of the anchor plate or in order that the mounting means may be threaded directly into the small diameter end of the bore in the anchor plate.

BRIEF DESCRIPTION OF THE DRAWINGS

FIG. 1 is a fragmentary, side elevational view, in cross section, of a tendon anchorage constructed in accordance with the present invention and secured to a concrete form for casting of the anchorage into a concrete member.

FIG. 2 is a fragmentary, side elevational view, in cross section, of the anchorage illustrated in FIG. 1 after casting of the concrete member, removal of the concrete form and tensioning of the tendon.

FIG. 3 is a fragmentary, side elevational view, in cross section, of an alternative embodiment of the tendon anchorage of the present invention suitable for anchoring a tendon inclined to the form board.

FIG. 4 is a fragmentary, side elevatonal view, in cross section, of the tendon anchorage of FIG. 3 after casting of the concrete member, removal of the form and tensioning of the tendon.

Referring now to FIGS. 1 and 2, there is illustrated a tendon anchorage constructed in accordance with the present invention which is particularly well suited for use as a cast-in-place type of tendon anchorage for prestressing applications. The anchorage is comprised of a bearing plate 111 and bearing plate locating device consisting of tubular member 113 and spacing or block-out member 114, which are urged against form board 116 by nut 117 and threads 118 at the small diameter end of bore 136 in the bearing plate. As above described mounting member 113 is formed with externally threaded outer end 119 and inner end 121, which are preferably threaded over a substantial portion of the ends to afford continuous axial adjustment at both ends to bring the assembly into close abutting relation with form board 116. Tendon 122 is here illustrated as a strand type of prestressing tendon having a cable-like construction, but wires and bars may be similarly secured. The strand can be wrapped in paper 133 and conveniently taped or otherwise blocked by member 124 against entry of concrete into the end 121 of mounting means 113.

In order to insure that bearing plate 111 is cast into the concrete 138 in a proper orientation with respect to tendon 122, tapered bore 136 terminates in a threaded end 118 which mates with threaded inner end 121 of mounting tube 113. Thus, the axis of bore 136 is coaxially aligned with the axis of mounting tube 113 with the result that the bearing plate is secured in perpendicular relation to the mounting tube. Mounting tube 113 is further formed with an internal diameter or bore dimensioned to receive tendon 122 in general coaxial alignment therewith resulting further in the perpendicular orientation of bearing plate 111 to tendon 122, which is highly desirable in order to minimize any bending of the tendon at the anchorage.

Bearing plate 111 in this configuration further acts as an anchor member by being formed with a frusto-conical bore 136. As above described, mounting means 113 can be inserted through openings or bores 132 and 133 in the spacing member and form, respectivey, and past the frusto-conical portion of the mounting means and screwed into the teeth 118 in bearing plate 111.

It is preferable and an important advantage of the anchorage of the present invention that the mounting means be further formed in order to form a recess in the concrete on the bearing surface side of the anchorage sufficient to accommodate axial advancement of the ends 142 of wedges 131 beyond surface 126. Thus, the mounting apparatus of the present invention functions additionally to provide a recess into which the tendon gripping wedges may move in advancing to a position of maximum radial gripping force.

FIG. 2 illustrates the concrete member with the anchorage of the present invention in place. Form 116 and block-out member 114 have been removed, resulting in recess 128 allowing access to bearing plate 111. Segmental wedges 131, held together by O-ring 141, are inserted into bore 136 to grip the tendon. The segmental wedges are preferably provided with tendon gripping serrated surfaces 139.

The versatility of the anchorage of the present invention can further be illustrated in that bearing plate 111 can alternatively be formed with a cylindrical bore dimensioned to receive tendon 122. Spacing block-out member 114 can be dimensioned to have a sufficient thickness so that recess 128 is of sufficient depth to accommodate the later insertion of a wedge containing housing or anchor member. Thus, the mounting means would be used to locate the bearing plate and upon removal of the spacer and form an anchor member and tendon gripping wedges could be slipped over the end of tendon 122 to allow tensioning of the tendon and later grouting of recess 128. An anchorage construction wherein the anchor member is subsequently inserted as a separate unit can be highly advantageous. When this approach is used the problem of entry of small amounts of concrete around block-out member 114 into frusto-conical bore 136 is eliminated. Similarly the problem of rust forming in or corrosion of the wedge receiving bore can be controlled and eliminated since the anchor member, if not cast into the beam, can be kept in a controlled environment and properly treated to prevent rust and corrosion. This type of construction is illustrated in FIGS. 3 and 4 and will be examined in more detail below.

The spacing or block-out members as illustrated throughout the drawings are formed of wood. Several other materials and constructions, however, will suffice for the apparatus of the present invention. For example, block-out members have previously been formed of rubber, sheet metal and plastic. Moreover, while the spacing members are preferably removable from the concrete member in order that they may be reused in the subsequent placement of anchorages, the block-out and spacing member may consist of a sleeve, as opposed to a solid member, which is permanently left in the concrete member with the interior diameter of the sleeve providing an access recess to the bearing plate or anchor member.

The tendon anchorage illustrated in FIG. 2 and particularly the combination of bearing plate 111 and wedges 131, while highly advantageously employed in a cast-in-place type of anchorage, may also be advantageously employed in other prestressing applications, such as dry mounting the anchorage on the end of a concrete member.

By way of example, bearing plate 111 can be formed of C1040 steel having a Rockwell hardness of between about 15 to about 28 on the Rockwell C scale. In order to grip a strand having a nominal diameter of 0.60 the bearing plate may be formed with a thickness of about ¾ to 1 inch. with bore 136 having a diameter at the small end of about 1-1/4 inches and a taper of about 10°. The wedge material was C1117 steel, case hardened to about 0.015 to 0.020 inches and having a Rockwell hardness of about 62 on the Rockwell C sclae. The wedges were stressed relieved at 350° F to avoid delay failure. Under these conditons, the strand could be tensioned to substantially its yield point by the anchorage without deformation of the bearing plate or failure of the wedges. Teeth 118 were tapped into the front end or small diameter end of the bearing plate, and since they diverge away from the 10° taper of the wedges, they did not interfere with the advancement of the wedges. The wedges were 2 inches in length with approximately one-quarter of their length or ½ inch projecting forwardly of surface 126 at maximum loading thereof. The diameter of end 142 of the wedges was about 1-1/16 inches with the large diameter of the wedges being about 1¾ inches.

Referring now to FIGS. 3 and 4 there is illustrated an alternate embodiment of the anchorage of the present invention in which anchor plate 151 is formed with a cylindrical bore or opening 176 and is positioned from form board 156 by a spacer 154 of sufficient depth to allow insertion of anchor member 152 into recess 168 after casting concrete member 178. Since tendons often must be draped very accurately in a concrete member with their exact positions determined by the use of a transit, the anchor plate of FIGS. 3 and 4 is shown in skewed relation to form board 156 as would often occur at the ends of a large beam.

The alignment feature of the present invention allows bearing plate 151 to be perpendicularly oriented relative to tendon 162, a task which is more difficult but very important when the tendon is skewed to the form board. Thus, mounting tube 153 is formed with threaded inner end 161 and outer end 159. Passing through bore 155 in tube 153 is relatively rigid tendon 162. The tendon has been accurately aligned by a transmit, and positioning of mounting tube 153 on tendon 162 results in the substantially coaxial alignment of the mounting tube with the tendon. If the tendon, for example, is a 0.60 inch steel strand it will be virtually rigid over the length of the mounting tube. Opening 176 in plate 151 is dimensioned to cause the plate to be perpendicularly oriented to tube 153 and, thus, tendon 162. As best may be seen in FIG. 4, this perpendicular orientation of plate 151 is important in order to transfer the axial load of the tendon evenly to bearing surface 166 and to aovid bending at end 182 of wedge 171. Since plate 151 is generaly planar on both sides wedges containing housing 152, which is placed in the anchorage after casting member 178, will similarly be aligned with bore 176 and tendon 162 upon engagement of housing 152 with anchor member side 165 of the plate. As will be understood, reinfocing flanges or webs might protrude from either side 165 or 166 without interferring with the general orientation of housing 152 or bearing surface 166.

As illustrated in this embodiment, plate 151 is urged against spacer 154 and form board 156 by nuts 157 and 158. Additionally, nut 160 is permanently fastened, as by welds 150, to tube 153 to facilitate unscrewing of inner end 161 from nut 158 and removal of the tube. The tendon is again illustrated as being greased and wrapped, as by wrapping 163, and is sealed at the front end of the mounting tube by tape or plastic member 164. Additionally, spacer 154 is formed with a truncated form board engaging surface 185, depending on the angle of drape of tendon 162. In order to allow cinching down of the assembly a truncated washer 186 is positioned between the form board and nut 157. Spacer 154 and form board 156 are further preferably formed with openings or channels 172 and 173, respectively, to allow the mounting tube to pass therethrough.

We claim:

1. A method of forming a cast-in-place concrete structure with a recess for receiving an anchorage for securement of a concrete reinforcing tendon including the steps of positioning a bearing plate formed with an opening dimensioned to receive said tendon around said tendon in spaced relation to a concrete form, positioning spacing means formed with an opening therein dimensioned to receive said tendon around said tendon with said opening in said spacing means in axial alignment with said opening in said bearing plate, securing said bearing plate in fixed spaced relation to said form with said spacing means in abutting relation with said bearing plate and, with said form, pouring concrete into said form about said tendon, bearing plate and spacing means and allowing said concrete to harden, and removing said form and said spacing means, wherein the improvement in said method of forming a cast-in-place concrete structure with a recess for receiving an anchorage comprises the step of:

after removing said form and said spacing means, inserting a tendon anchorage formed to receive convergently actuating gripping means into said recess formed by said spacing means around said tendon and against said bearing plate.

2. The method of forming a cast-in-place concrete anchorage as defined in claim 1 wherein, said inserting step is accomplished immediately prior to tensioning of said tendon, and positioning convergently actuating gripping means in said tendon anchorage prior to tensioning said tendon.

* * * * *